US008887679B2

(12) United States Patent
Girard et al.

(10) Patent No.: US 8,887,679 B2
(45) Date of Patent: Nov. 18, 2014

(54) VALVE ACTUATION MECHANISM AND AUTOMOTIVE VEHICLE COMPRISING SUCH A VALVE ACTUATION MECHANISM

(75) Inventors: Benjamin Girard, Saint Laurent de Mure (FR); Romain Le Forestier, Reyrieux (FR)

(73) Assignee: Renault Trucks, St. Priest (FR)

( * ) Notice: Subject to any disclaimer, the term of this patent is extended or adjusted under 35 U.S.C. 154(b) by 0 days.

(21) Appl. No.: 14/127,270

(22) PCT Filed: Jul. 22, 2011

(86) PCT No.: PCT/IB2011/002448

§ 371 (c)(1),
(2), (4) Date: Dec. 18, 2013

(87) PCT Pub. No.: WO2013/014490

PCT Pub. Date: Jan. 31, 2013

(65) Prior Publication Data

US 2014/0144400 A1 May 29, 2014

(51) Int. Cl.

| | |
|---|---|
| ***F01L 1/18*** | (2006.01) |
| ***F01L 1/34*** | (2006.01) |
| ***F01L 13/00*** | (2006.01) |
| ***F01L 13/06*** | (2006.01) |
| ***F01L 13/08*** | (2006.01) |
| *F01L 1/26* | (2006.01) |

(52) U.S. Cl.

CPC . *F01L 1/34* (2013.01); *F01L 1/181* (2013.01); *F01L 13/0021* (2013.01); *F01L 13/06* (2013.01); *F01L 13/08* (2013.01); *F01L 1/267* (2013.01)

USPC ..... 123/90.39; 123/90.44; 123/90.45; 123/90.46

(58) Field of Classification Search

USPC ..... 123/90.39, 90.44, 90.45, 90.46

See application file for complete search history.

(56) References Cited

U.S. PATENT DOCUMENTS

| | | | |
|---|---|---|---|
| 6,189,504 | B1 | 2/2001 | Israel et al. |
| 6,253,730 | B1 | 7/2001 | Gustafson |

(Continued)

FOREIGN PATENT DOCUMENTS

| | | | |
|---|---|---|---|
| WO | 9009514 | A1 | 8/1990 |
| WO | 9108381 | A1 | 6/1991 |

OTHER PUBLICATIONS

International Search Report (Mar. 30, 2013) for corresponding international application No. PCT/IB2011/002448.

*Primary Examiner* — Ching Chang
(74) *Attorney, Agent, or Firm* — WRB-IP LLP

(57) ABSTRACT

A valve actuation mechanism for an internal combustion engine includes rockers moved by a camshaft, each rocker being adapted to exert a valve opening force on at least a portion of a valve actuation mechanism of each cylinder belonging to a housing of the engine, via an engine brake activation piston, housed in a bore of the rocker, and movable with respect to the rocker under action of a fluid pressure raise in a chamber fluidly linked to the bore, from a first position, in which an engine brake function is deactivated, to a second position, in which a roller of the rocker reads at least one engine brake bump of a cam of the camshaft so as to perform the engine brake function. Each rocker includes a discharge valve movable in translation with respect to the rocker, adapted to reduce fluid pressure in the chamber. The engine brake system includes, for each rocker, a stopper fast with the housing and adapted to exert, on a portion of the piston, a force for opening the discharge valve when the activation piston has to be moved from its second position to its first position.

20 Claims, 6 Drawing Sheets

(56) References Cited

U.S. PATENT DOCUMENTS

| | | | | |
|---|---|---|---|---|
| 6,422,186 | B1 | 7/2002 | Vanderpoel | |
| 7,392,777 | B2 * | 7/2008 | Faria et al. | 123/90.39 |
| 2003/0024501 | A1 | 2/2003 | McCarthy et al. | |
| 2010/0307451 | A1 | 12/2010 | Lee et al. | |

* cited by examiner

VALVE ACTUATION MECHANISM AND AUTOMOTIVE VEHICLE COMPRISING SUCH A VALVE ACTUATION MECHANISM

BACKGROUND AND SUMMARY

The invention concerns a valve actuation mechanism for an internal combustion engine on an automotive vehicle. The invention also concerns an automotive vehicle, such as a truck, equipped with such a valve actuation mechanism.

Automotive vehicles, such as trucks, often rely on an engine brake function to slow down in order, for example, to reduce wear on brake pads, particularly on downward slopes. It is known to perform engine brake by acting on the amount of gas present in the cylinders of the engine in two distinct phases. In a first phase, when the pistons are at near a bottom dead center position, one injects exhaust gases into the chambers of the cylinders so as to slow down the pistons when they move towards their high level. This is done by slightly opening at least a valve connected to an exhaust manifold, while exhaust gases are prevented to be expelled from the exhaust pipe, and thereby at a certain pressure above atmospheric pressure. In the second phase, the gases which are compressed by the piston are expelled from the chamber of the cylinder when the piston is at high level in order to prevent an acceleration of the piston under effect of volumic expansion of compressed gas. This is done by slightly opening a valve so as to expel gases from the cylinder. In most cases, the valve (or valves) which is (are) opened for the engine brake function is (are) a main exhaust valve. An engine brake system is described in document WO 9009514.

To perform these engine brake valves movements, also called engine brake valves lifts, the engine comprises, for each cylinder, a rocker acting on the valves to open and close them. The rocker is acted upon by a rotating cam which has at least one lift sector to cause the lifting (opening) of the valve. If the valve is also an exhaust or an intake valve, the corresponding cam will comprise a main valve lift sector and one or several auxiliary valve lift sectors (also called main valve lift bump and auxiliary valve lift bump) When engine brake is needed, a cam follower surface of the rocker is moved in close contact with a cam of a camshaft moving the rocker so that the brake movements of the valve are obtained, when the cam follower interacts with the auxiliary valve lift sectors. In normal operating conditions of the engine, the valves should not perform these movements and the roller of the rocker is kept slightly remote from the engine brake rams so that the cam follower does not interact with the auxiliary valve lift sectors. The distance or clearance between the roller and the engine brake cams ensures that only the larger main lift sector on the cam, dedicated to the main exhaust event, causes an opening of the exhaust valve, but not one or several smaller auxiliary lift sectors dedicated to the engine brake function. This clearance is suppressed when engine brake is needed, by moving an activation piston of the rocker to make to close contact between the roller and the cam, so that engine brake dedicated lift sectors on the cam also cause an opening of the valve. An engine brake system having such valve actuation mechanism is described in WO-91/08381

In the case of a system where two valves are to be actuated, the piston can be in contact with the valves through a valve bridge.

When the engine brake valve opening(s) have been performed, a reset function is preferably to be performed. In other words, the activation piston needs to be moved towards its initial position in order to ensure that the valves are closed early enough in order to extended valve lift overlap which could compromise engine brake performance.

Engine brake systems generally comprise a control valve to direct pressurized control fluid pressure in a chamber adjacent to the piston to move the piston from its initial position to its engine brake actuation position. The control valve controls whether or not the engine brake function is activated. This control valve lets pressurized control fluid flow, at a pressure of for example 2 to 5 bars, towards each rocker as long as the engine brake function is needed, which typically lasts several seconds or tens of seconds during which the engine and the cam shaft may perform several hundreds or thousands of complete revolutions. In some systems, a check valve is provided to prevent any fluid flow out of the chamber. In some known systems, such as the one described in WO-91/08381, the check valve can nevertheless be forced to an open position, allowing the control fluid to escape the chamber when the engine brake is not needed. This is achieved when no control pressure is sent to the control valve. In known systems, there is only one control valve for several cylinders, so that it is not possible to use the control valve to empty the chamber to allow retraction of the piston, if such retraction is needed for a period of time inferior to one revolution of the camshaft.

It is known, for example from U.S. Pat. No. 6,253,730, to act on the check valve thanks to a stopper which is fixed to a housing of the engine, so as to open the check valve and release fluid pressure in the chamber so that the piston may move towards its initial position, retracted. This technical solution does not insure a satisfying reliability.

The aim of the invention is to provide a new valve actuation mechanism in which, when a specific operation function of the engine must be activated, the activation piston can be reset to its first position in a more efficient and reliable way than in the prior art.

To this end, the invention concerns a valve actuation mechanism for an internal combustion engine on an automotive vehicle, comprising rockers moved by a camshaft, each rocker being adapted to exert a valve opening force on at least a portion of a valve opening actuator of each cylinder belonging to a housing of the engine, via an activation piston, housed in a bore of the rocker, and movable with respect to the rocker under action of a fluid pressure raise in a chamber fluidly linked to the bore, from a first position to a second position, in which a cam follower of the rocker reads at least one auxiliary valve lift sector of a cam of the camshaft so as to perform an engine operating function, each rocker comprising a discharge valve movable in translation with respect to the rocker and adapted to reduce fluid pressure in the chamber. This valve actuation mechanism is characterized in that it comprises, for each rocker, a stopper fast with the housing and adapted to exert, on a portion of the piston, a force for opening the discharge valve when the piston has to be moved from its second position to its first position.

Thanks to the invention, the activation piston is set back to its first position by reducing the fluid pressure in the chamber thanks to the discharge valve, and by a mechanical part acting on the piston independently for each rocker. This improves the reliability of the valve actuation mechanism.

According to further aspects of the invention which are advantageous but not compulsory, such a valve actuation mechanism may incorporate one or several of the following features:

The stopper comprises a rod having an end fixed to the engine by a fastening flange at another end comprising a pushing zone.

The discharge valve is a normally closed valve which is opened by the fluid pressure in the chamber when such pressure exceeds a predetermined threshold.

The discharge valve comprises a plug member, which is spring-biased against a seat realized on a surface of the rocker and which is exposed to a fluid pressure force exerted by fluid in the chamber, said fluid pressure acting on the plug member against the biasing action of the spring.

The discharge valve is carried by the piston.

The discharge valve comprises a ball which is spring biased by a compression spring against a seat extending around a passageway fluidly linking a hollow portion of the piston and the chamber, and wherein the piston comprises at least one bleed passage adapted to allow passage of fluid from the hollow portion of the piston to the outside of the piston.

The force exerted by said compression spring on the ball of the discharge valve is inferior to the force (Fp) exerted by the fluid of the chamber on said ball when the force of the stopper is exerted on the piston.

The piston comprises a first element housed in the bore and movable in translation with respect to the rocker, and a valve member, carrying the discharge valve, housed in a hollow portion of the first element the valve member being movable in translation with respect to the first element along a longitudinal axis of the piston, wherein the valve member comprises a pushing surface adapted to exert the valve opening force on the valve opening actuator, and wherein the valve member comprises at least one bleed passage adapted to allow passage of fluid from the hollow portion of the first element to the outside of the piston.

The valve member is movable with respect to the first element between a first position corresponding to a closed position of the discharge valve, in which a plate of the valve member is maintained, by action of a spring exerting a compression force between the first element and the valve member, in abutment against a stop of the first element, and in which passage of fluid between the chamber and the hollow portion of the first element is blocked, and a second position corresponding to an opened position of the discharge valve, in which the valve member is offset with respect to the first element and fluid can circulate between the chamber and the hollow portion of the first element.

The force of the stopper is exerted by contact between the stopper and the valve member, and wherein the compression force exerted by said spring is inferior to the force exerted by the stopper on the valve member.

The discharge valve is housed in the rocker apart from the piston.

The force of the stopper is exerted by contact between the stopper and the piston, and wherein the force exerted by the fluid in the chamber when the stopper is in contact with the piston is superior to the compression force exerted by said spring.

The rocker comprises a bleed passage fluidly linking the chamber and the outside of the rocker, and adapted to be selectively opened or closed by the discharge valve.

The force exerted by the stopper is variable and becomes superior to a force which keeps the discharge valve in a closed position only when the piston has to be moved from its second position to its first position and remains superior to said force until the piston is back in its first position.

The stopper comprises a main spring adapted, when deformed, to exert a compression force on a pushrod on which the pushing zone is realized.

The valve actuation mechanism is an exhaust valve actuation mechanism.

The activation piston activates an exhaust gases recirculation function when it is in its second position.

The activation piston activates an engine brake function when it is in its second position.

The valve actuation mechanism is an intake valve actuation mechanism.

The invention also concerns an automotive vehicle, such as a truck, comprising a valve actuation mechanism as mentioned here above.

BRIEF DESCRIPTION OF THE DRAWINGS

The invention will now be explained in correspondence with the annexed figures, as an illustrative example. In the annexed figures.

DETAILED DESCRIPTION OF SOME EMBODIMENTS

Figure 1:
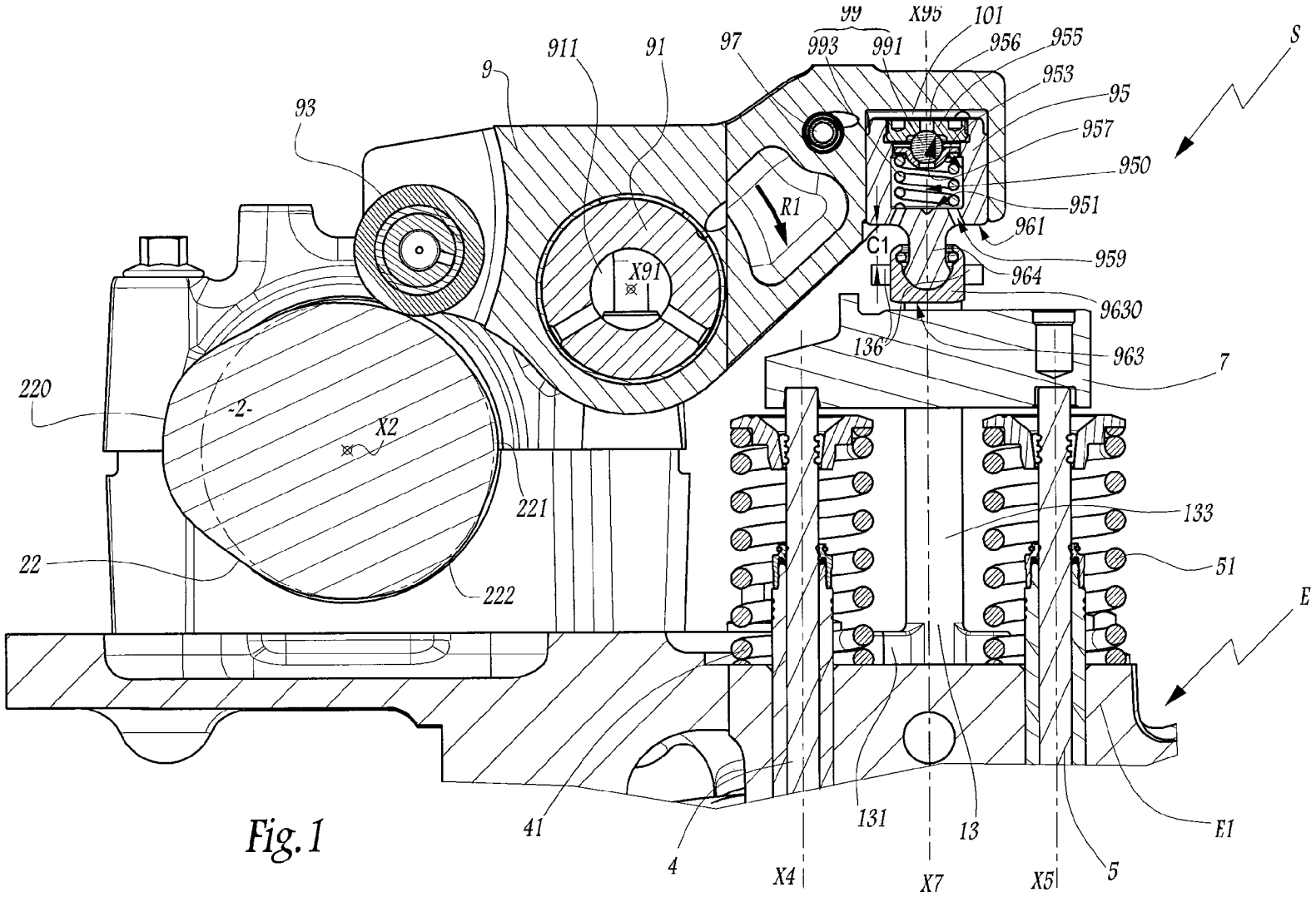
FIG. 1 is a sectional view, along a medial plane, of a valve actuation mechanism according to a first embodiment of the invention, in a first configuration.

The valve actuation mechanism S represented on FIG. 1 comprises a camshaft 2 rotatable around a longitudinal axis X2. Camshaft 2 comprises several cams 22, each being dedicated to moving the valves of one cylinder of an internal combustion engine F of a non-represented automotive vehicle on which valve actuation mechanism S is integrated. Each cam has a cam profile which may comprise one or several "humps", i.e. valve lift sectors where the cam profile exhibits a bigger eccentricity with respect to axis X2 than the base radius of the cam.

In this embodiment, each cylinder of engine E is equipped with two exhaust valves 4 and 5. Valves 4 and 5 are kept in a closed position by respective springs 41 and 51. Each valve 4 and 5 is movable in translation along an opening axis X4 or X5 so as to be opened, or lifted. More precisely, translation of valves 4 and 5 opens a passageway between the combustion chamber of the cylinder and an exhaust manifold. Valves 4 and 5 are connected to a valve bridge 7, which forms a valve opening actuator, and which extends substantially perpendicular to axes X4 and X5. In case only one valve is to be actuated, then the opening actuator can be integral with the valve, for example embodied as a top portion of the valve stem.

Figure 2:
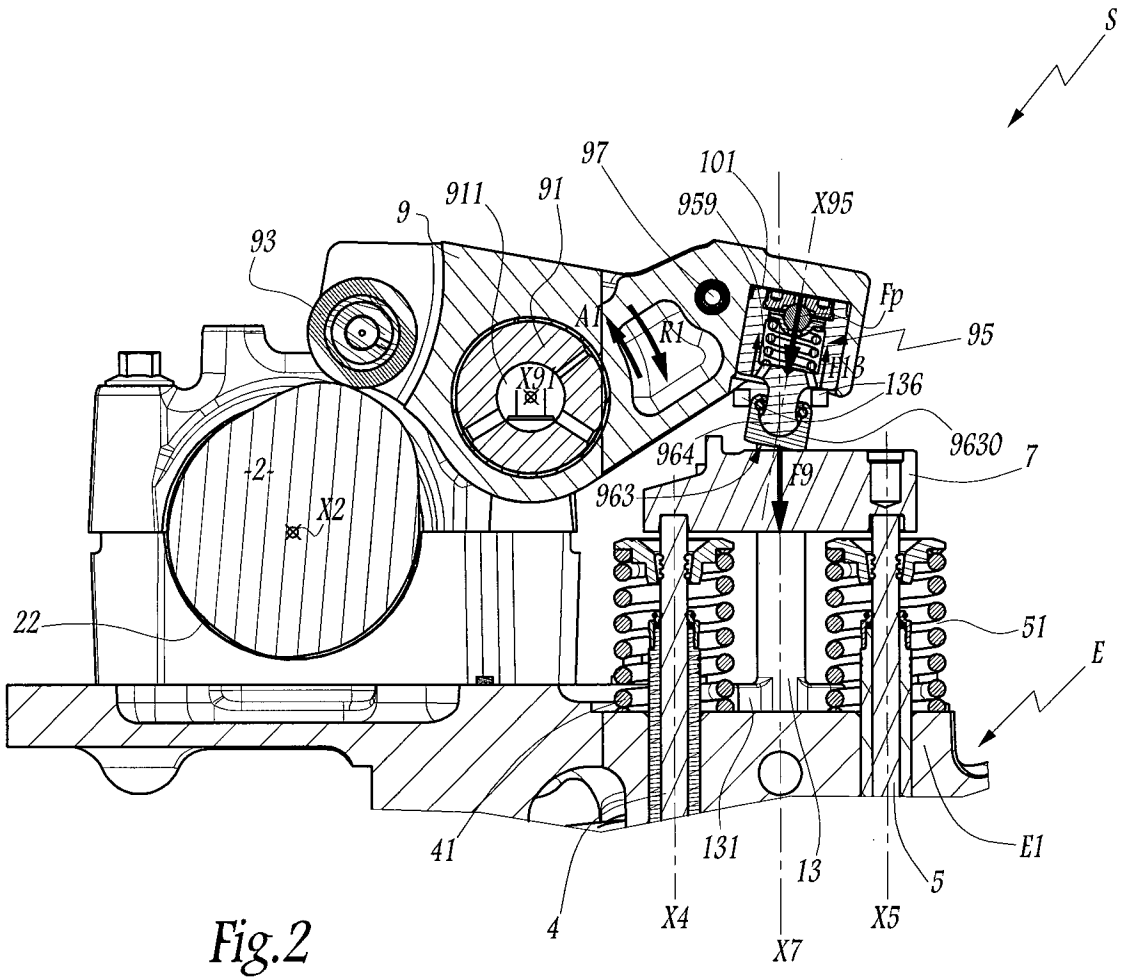
FIG. 2 is a sectional view similar to FIG. 1, for a second configuration of the valve actuation mechanism of FIG. 1.

Valves 4 and 5 are partly represented on FIGS. 1 and 2, out their respective stems are visible.

For each cylinder, the transmission of movement between camshaft 2 and valve bridge 7 is performed by a rocker 9 rotatable with respect to a rocker shaft 91 defining a rocker rotation axis X91. Only one rocker 9 is represented on the figures. Each rocker 9 comprises a roller 93 which acts as a cam follower and cooperates with a cam 22. Roller 93 is located on one side of rocker 9 which respect to shaft 91. Each rocker 9 comprises, opposite to roller 93 with respect to shaft 91, an activation piston 95 adapted to exert a valve opening force F9 on the whole of valve bridge 7. Particularly, rotation of camshaft 2 transmits, when the roller runs a valve lift sector of the cam, a rotation movement R1 to rocker 9 via roller 93, this rotation movement inducing a translation movement of valve bridge 7 along an axis X7 which is parallel to axes X4 and X5. The rocker can therefore rotate between a valve closing position and a valve opening position, depending on the cam profile.

Cooperation between a main valve lift sector 220 of cam 22 and roller 93, on the one hand, and between piston 95 and bridge 7, on the other hand, generates exhaust openings of valves 4 and 5 during the corresponding operating phase of internal combustion engine E.

In the shown embodiment, rocker shaft 91 is hollow and defines a duct 911 which houses a control fluid circuit connected to a non-shown fluid tank of valve actuation mechanism S. Rocker 9 comprises a non represented internal fluid circuit which fluidly connects duct 911 to a piston chamber 101 of rocker 9, delimited by piston 95, via a check valve 97. Piston 95 is housed in a bore 94 of rocker 9 and adapted to move with respect to chamber 101 along a translation axis X95 corresponding, to a longitudinal axis of piston 95.

Cam 22 comprises at least one, here two auxiliary valve lift sectors 221 and 222 which are adapted to cooperate with roller 93. These sectors induce, when read by roller 93 of rocker two additional pivoting movements of rocker 9 on each turn of camshaft 2. The auxiliary lift sectors 221 and 222 are usually designed to cause only a limited lift of the valve, as they are not intended to allow a great flow of gases through the valve. These two pivoting movements are transformed by piston 95 into two opening movements of valves 4 and 5 so as to perform an engine brake function at two precise moments during operation of engine E as described briefly above. The purpose and effects of these valve openings are well-known and will not be further described hereafter. According to an alternate embodiment, cam 22 comprises only one auxiliary valve lift sector for performing only one opening of valves 4 and 5 on each turn of camshaft 2, in addition to the main exhaust valve opening.

When engine E switches to engine brake mode, check valve 97 is opened so that fluid can flow from duct 911 to the inside of rocker 9 and subsequently to piston chamber 101 so as to induce a pressure raise in piston chamber 101. The pressure raise in chamber 101 induces a translation movement of piston 95 outwardly with respect to rocker 9, from a first position, in which piston 95 is entirely or partially pushed back into chamber 101, to a second position, in which piston 95 is partially moved out of piston chamber 101 until it comes in abutment against valve bridge 7. Preferably, the control fluid is a substantially incompressible fluid such as oil.

When piston 95 is in its first position, retracted, as shown on FIG. 2, roller 93 is offset with respect to the auxiliary valve lift sectors 221 and 222 of cam 22 by an engine brake actuation clearance, so that when camshaft 2 rotates around axis X2, cam 22 does not come in contact with roller 93, or piston 95 does not come in contact with valve bridge 7. By moving piston 95 to its second position, extended, as shown on FIG. 4, rocker 9 pivots around the longitudinal axis X91 of shaft 91, in the direction of arrow A1. Thus, the actuation clearance is suppressed and roller 93 comes into contact with the auxiliary valve lift sectors of cam 22, allowing engine brake operations to be implemented.

According to a variant of the invention, piston 95 may be adapted to activate or deactivate an internal exhaust gases recirculation function. This function allows an exhaust valve opening during the intake stroke. By returning a controlled amount of exhaust gas to the combustion process, peak combustion temperatures are lowered. This will reduce the formation of Nitrogen oxides (NOx).

In the first embodiment of the invention represented on FIGS. 1 and 2, piston 95 comprises a hollow portion 950 delimited by an inner bottom surface 951 and an inner peripheral surface 953. The hollow portion of piston 95 is delimited, opposite to inner bottom 951, by an end plate 955 which has a central hole 956 and defines, on its side facing inner bottom 951, a seat surface 957. Central hole 956 defines a fluid passage between chamber 101 and hollow portion 950.

A discharge valve 99 is housed inside piston 95. Discharge valve 99 comprises a ball 991, which acts as a plug member for closing the valve 99 and which is spring biased against seat 957 by a spring 993.

Piston 95 further comprises two bleed passages 959 between hollow portion 950 and the outside of rocker 9. As an alternate embodiment, piston 95 may comprise only one bleed passage 959.

Valve actuation mechanism S comprises a stopper 13, which has a first end fast to a housing E1 of internal combustion engine E thanks to a fastening flange 131. Stopper 13 comprises a rod 133 extending from flange 131, and ending with a pushing zone 135. As shown on the figures, pushing zone 135 may have an optional half-circular shape extending between two parallel fingers 136. Fingers 136 are adapted to exert, on a surface 961 of piston 95, as force F13 tending to push back piston 95 in its first position. Piston 95 has a pushing surface 963 realized on a mobile element 9630 mounted in spherical joint on a pin 964 which extends from surface 961. The mobility of element 9630 permits to make a plane contact between valve bridge 7 and surface 963. Fingers 136 are adapted to cooperate with surface 961 around pin 964.

Valve actuation mechanism S works in the following way: when rocker 9 is in a position corresponding to the closed state of valves 4 and 5, a clearance C1 separates surface 961 of piston 95 and pushing zone 135 of stopper 13. Prior to the engine brake valve openings, piston 95 is moved to its second position, as shown on FIG. 1, thanks to a pressure raise in chamber 101.

When the engine brake function is activated, i.e. when control fluid is sent through the control valve to the rockers, and once the two engine brake valve openings have been realized thanks to a rotation R1 of rocker 9, a main exhaust opening of valves 4 and 5 is to be realized. Therefore, during the opening of valves 4 and 5, piston 95 must be pushed back to its first position thanks to force F13. Just before rotation R1 of rocker 9 reaches its maximal angular value, contact is made between surface 961 and fingers 136 of stopper 13. This induces a limitation of the valve opening to a maximum value and the exertion of force F13 on piston 95. As force F13 tends to move piston 95 towards its first position, this induces a pressure raise in chamber 101 and the exertion of a fluid pressure force Fp on ball 991 through central hole 956. Once fluid pressure force Fp becomes superior to the elastic force exerted by spring 993, contact between ball 991 and seat 957 is suppressed, allowing fluid to get in the hollow portion of piston 95 and purging of fluid through bleed passages 959. The fluid pressure in chamber 101 is subsequently reduced. This allows piston 95 to be pushed back in its first position at maximal opening of valves 4 and 5. Thus discharge valve 99 allows moving piston 95 to its first position, as shown on FIG. 2.

Figure 4:
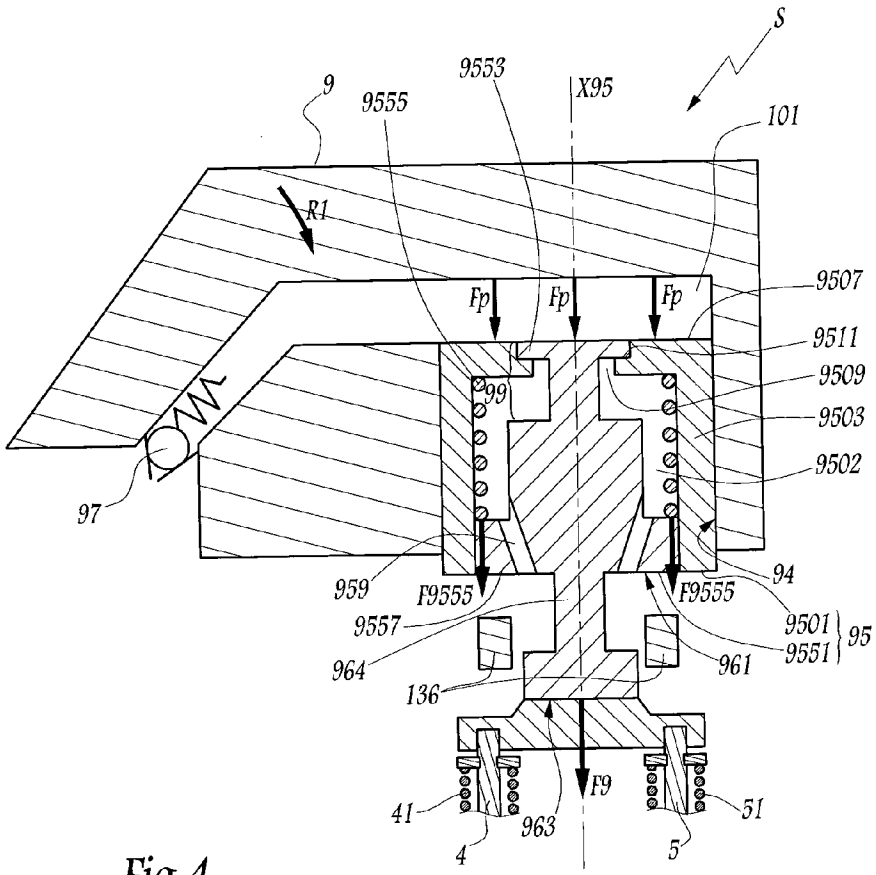
FIG. 4 is a partial sectional schematic view of a valve actuation mechanism according to a second embodiment of the invention, in a first configuration.
Figure 3:
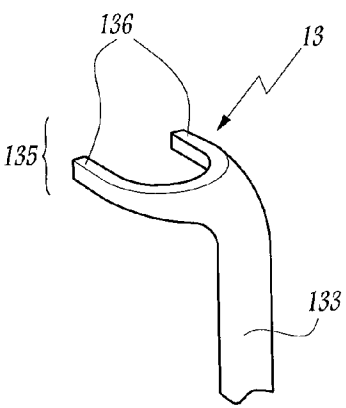
FIG. 3 is a perspective view of a stopper belonging to the valve actuation mechanism of FIGS. 1 and 2.
Figure 5:
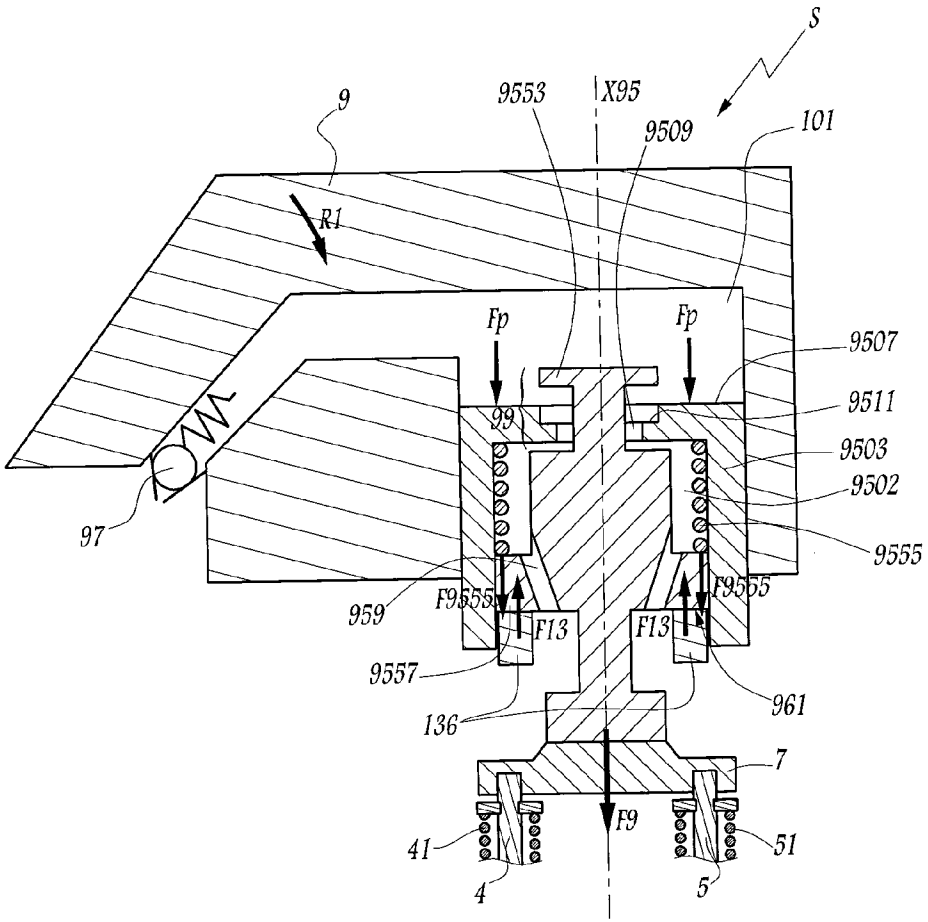
FIG. 5 is a view similar to FIG. 4, for a second configuration of the valve actuation mechanism of FIG. 4.
Figure 6:
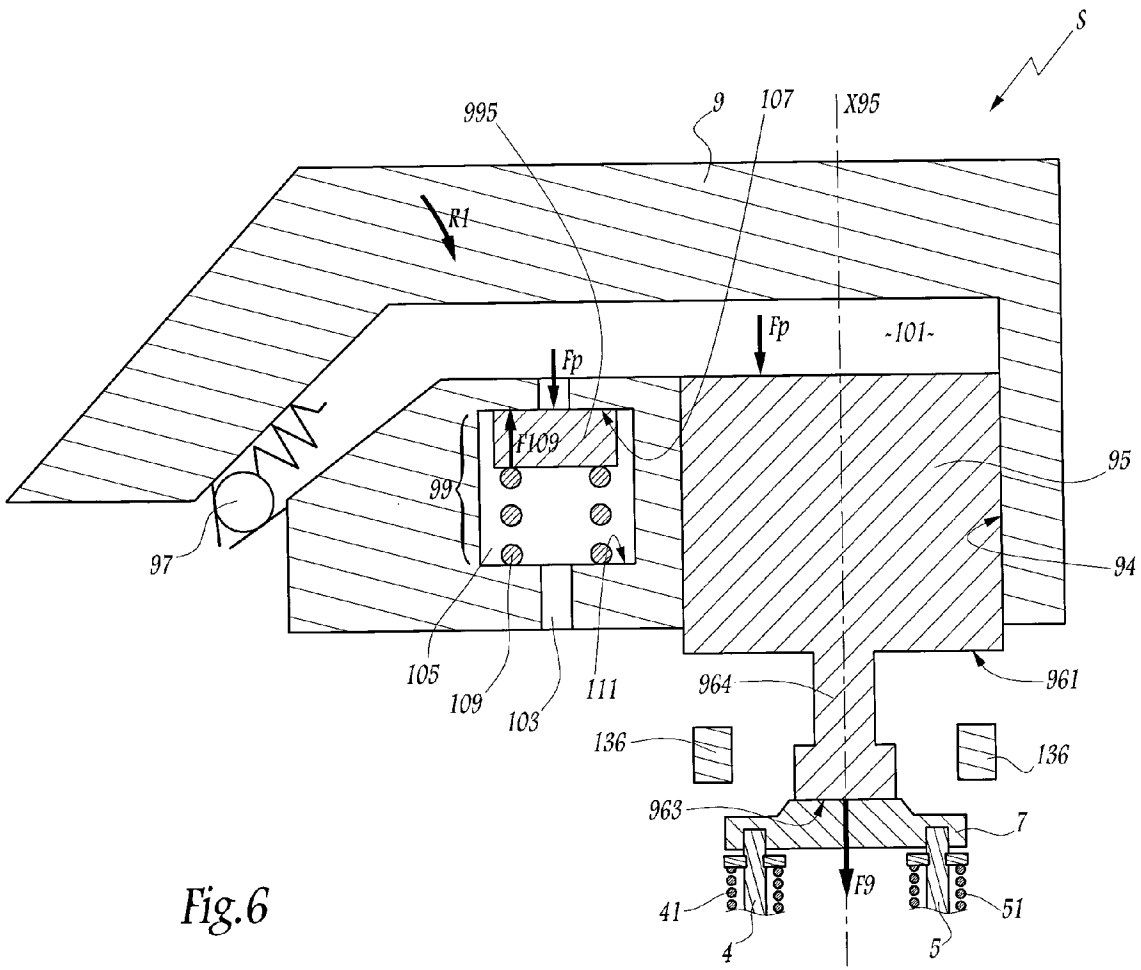
FIG. 6 is a view similar to FIGS. 4 and 5, for a valve actuation mechanism according to a third embodiment of the invention.

Discharge valve 99 operates in a very similar way to a safety valve which opens when overpressures occur in chamber 101. In this case, the presence of the stopper 13 causes the discharge valve 99 to open at each revolution of the camshaft 2 when the engine brake function is activated. In the embodiments of FIGS. 4 to 6, elements similar to the first embodiment bear the same references and work in the same way.

A second embodiment of the invention is represented on FIGS. 4 and 5. In this embodiment, piston 95 comprises a first element 9501, which has a hollow portion 9502 and comprises a tubular peripheral wall 9503 parallel to axis X95. A planar circular wall 9507 extends perpendicularly to axis X95 from an end of peripheral wall 9503 on the side of piston chamber 101. Plane wall 9507 comprises a central hole 9509 aligned with axis X95. Central hole 9509 forms a fluid passageway between chamber 101 and hollow portion 9502 of first element 9501. Central hole 9509 comprises a shoulder 9511, the portion of central hole 9509 located on the side of chamber 101 having a larger diameter than the other portion.

First element 9501 is mounted within a corresponding cylinder bore 94 created in the rocker 9 as a continuation of chamber 101 and having the same axis X95, and first element 9501 is adapted to move in translation with respect to rocker 9 along axis X95.

Piston 95 further comprises a valve member 9551 carrying discharge valve 99. Valve member 9551 is housed in hollow portion 9502 of first element 9501 and is movable in translation with respect to first element 9501, and subsequently with respect to rocker 9, along axis X95. Hollow portion 9502 is defined as the inside of the tubular peripheral wall 9503. Surface 961, pushing surface 963 and pin 964 are realized on valve member 9551. Valve 9551 comprises two bleed passages 959 adapted to let fluid flow from hollow portion 9502 of first element 9501 to the outside of rocker 9.

Valve member 9551 comprises an end plate 9553 which acts as a plug member and which is adapted to come in abutment against shoulder 9511 which acts as a valve seat. End plate 9553 is spring biased against shoulder 9511 by a force F9555 exerted by a compression spring 9555 arranged between first element 9501 and valve member 9551 in hollow portion 9502. Discharge valve 99 is formed by cooperation of end plate 9553 with central hole 9509 and shoulder 9511 under action of spring 9555.

Valve member 9551 comprises a base portion 9557 in which bleed passages 959 are realized and whose outer diameter corresponds to the inner diameter of peripheral wall 9503.

In this embodiment, fingers 136 of stopper 13 cooperate with surface 961 realized on base portion 9557 of valve member 9551. When contact is made between these two elements, force F13 exerted by stopper 13 induces a fluid pressure raise in chamber 101, because check valve 97 is closed and does not allow fluid flow outside chamber 101. Force Fp exerted by fluid pressure on piston 95 also rises and becomes superior to the compression force exerted by spring 9555 on valve member 9551. First element 9501 is therefore moved along axis X95, opposite to chamber 101. From this moment on, plate 9553 is not anymore in abutment against shoulder 9511 and discharge valve 99 is therefore opened, as shown on FIG. 5. Discharge valve 99 may be calibrated so as to open when pressure in chamber 101 reaches a value approximately comprised between 200 and 300 bars. Fluid then flows into hollow portion 9502 and is purged outside rocker 9 via bleed passages 959, thereby allowing the piston 95 to get back to its retracted position. Fluid pressure in piston chamber 101 also drops, allowing first element 9501 to subsequently set back to its initial position, in which plate 9553 is in abutment with shoulder 9511, under action of spring 9555.

A third embodiment of the invention is represented on FIG. 6. In this embodiment, piston 95 is made of a single part and does not comprise any hollow portion. Rocker 9 comprises a bleed passage 103, located apart from piston 95, and fluidly connecting piston chamber 101 and the outside of rocker 9. Bleed passage 103 comprises an intermediate chamber 105 in which discharge valve 99 is housed, so as to selectively open or close bleed passage 103. Intermediate chamber 105 comprises, on the side of chamber 101, a seat surface 107. Discharge valve 99 comprises a plug member or valve element 995, which is spring biased against seat surface 107, by a force F109 exerted by compression spring 109 arranged between a bottom wall 111 of chamber 105 and valve element 995.

This embodiment of the invention works in the following way: stopper 13 cooperates with surface 963. At the time contact is made between fingers 136 and surface 961, the fluid pressure raise in chamber 101 increases fluid force Fp, which is exerted on valve element 995. Once force Fp becomes superior to the force F109 exerted by spring 109, valve element 995 is moved towards bottom wall 111 and valve element 995 is not anymore in sealing contact with seat surface 107. Discharge valve 99 is then opened and fluid flows into intermediate chamber 105 and is subsequently purged outside of rocker 9.

As in the other embodiments, fluid pressure in chamber 101 drops, allowing piston 95 to be pushed back in this first position under action of stopper 13.

Figure 7:
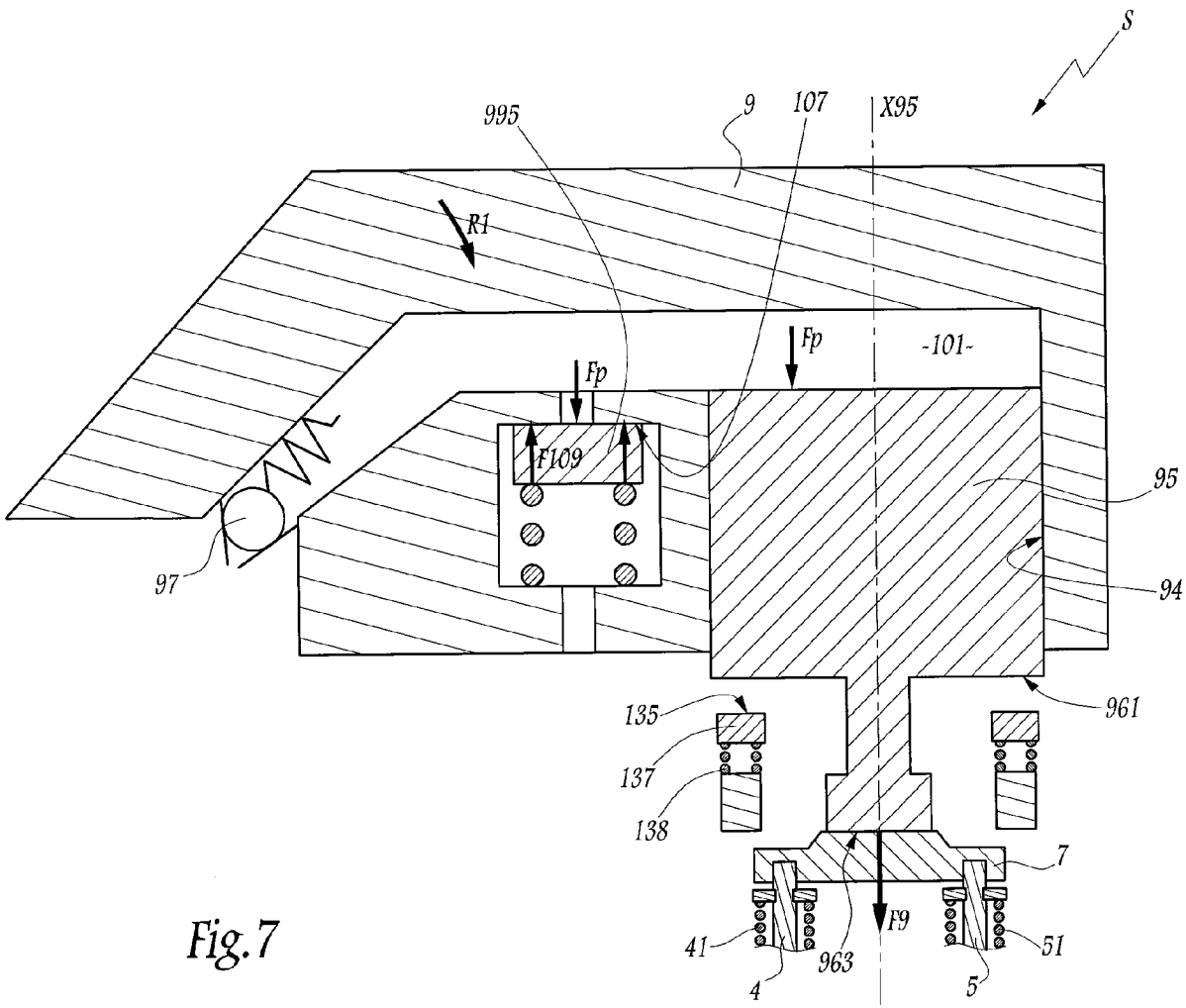
FIG. 7 in a view similar to FIG. 6, for a valve actuation mechanism according to a fourth embodiment of the invention.

A fourth embodiment of the invention is represented on FIG. 7. Hereafter, only the differences between this fourth embodiment and the third embodiment are discussed. In this embodiment, stopper 13 exerts a variable force F13 which becomes superior to the force Fp which keeps discharge valve 99 in its closed position only when piston 95 has to be moved from its second position to its first position. Stopper 13 comprises a pushrod 137 carrying pushing zone 135, and a spring 138 exerting a force on pushrod 137. This arrangement permits to operate the reset function at the right and with relatively low forces involved. The hysteresis effect of spring 138 implies that force F13 remains superior force Fp until piston 95 is back in its first position.

This embodiment is described as implemented with the design of the embodiment of FIG. 6. The embodiment of FIG. 7 can be combined with the designs of embodiments of FIGS. 1 to 5. Particularly, stoppers 13 described in the embodiments of FIGS. 1 to 5 can be equipped with a spring 138 to exert a variable force F13.

According to a non-shown embodiment of the invention, valve actuation mechanism S can implement the single valve brake technology, in which the engine brake function is performed by opening only one of exhaust valves 4 and 5.

According to a non-shown embodiment of the invention, valve actuation mechanism S may apply to an engine having cylinders equipped with a single exhaust valve and a single intake valve. In this case, each rocker 9 is adapted to move only one valve, and the valve opening actuator does not comprise any bridge, the single exhaust or intake valve being moved via an intermediate part adapted to cooperate with piston 95.

In all the cases above, the stopper 13 does not act on the discharge valve, but the valve opens under the actions of the pressure of the control fluid in the chamber 101, this pressure being created by the force F13 of the stopper 13 on the piston 95, which force is in opposition to the travel direction of the rocker 9 towards its maximum angular position. The position of the stopper, which is fixed with respect to the engine housing, can be set so that it interferes with the piston during the travel of the rocker at a given position of the rocker between its valve closing and valve opening positions. Therefore, the position of the stopper with respect to the housing and with respect to the rocker defines the timing at which the activation piston has to be moved from its second position to its first position in the valve opening and closing cycle. The position of the stopper can be made adjustable for a fine-tuning of the timing at which the activation piston is effectively moved from its second position to its first position.

The invention claimed is:

1. A valve actuation mechanism for an internal combustion engine on an automotive vehicle, comprising rockers moved by a camshaft, each rocker being adapted to exert a valve opening force on at least a portion of a valve opening actuator of each cylinder belonging to a housing of the engine, via an activation piston, housed in a bore of the rocker, and movable with respect to the rocker under action of a fluid pressure raise in a chamber fluidly linked to the bore, from a first position to a second position, in which a cam follower of the rocker reads at least one auxiliary valve lift sector of a cam of the camshaft so as to perform an engine operating function, each rocker comprising a discharge valve, adapted to release fluid from the chamber when pressure in the chamber exceeds a certain level, wherein the valve actuation mechanism comprises, for each rocker, a stopper fast with the housing and adapted to exert, on a portion of the activation piston, a force for opening the discharge valve when the activation piston has to be moved from its second position to its first position.

2. The valve actuation mechanism according to claim 1, wherein the stopper comprises a rod having an end fixed to the engine by a fastening flange and another end comprising a pushing zone.

3. The valve actuation mechanism according to claim 1, wherein the discharge valve is a normally closed valve which is opened by the fluid pressure in the chamber when such pressure exceeds a predetermined threshold.

4. The valve actuation mechanism according to claim 1, wherein the discharge valve comprises a plug member, which is spring-biased against a seat realized on a surface of the rocker and which is exposed to a fluid pressure force exerted by fluid in the chamber, the fluid pressure acting on the plug member against the biasing action of the spring.

5. The valve actuation mechanism according to claim 1, wherein the discharge valve is carried by the piston.

6. The valve actuation mechanism according to claim 1, wherein the discharge valve comprises a ball which is spring biased by a compression spring against a seat extending around a passageway fluidly linking a hollow portion of the piston and the chamber, and wherein the piston comprises at least one bleed passage adapted to allow passage of fluid from the hollow portion of the piston to the outside of the piston.

7. The valve actuation mechanism according to claim 6, wherein the force exerted by the compression spring on the ball of the discharge valve is inferior to the force exerted by the fluid of the chamber on the ball when the force of the stopper is exerted on the piston.

8. The valve actuation mechanism according to claim 1, wherein the piston comprises a first element housed in the bore and movable in translation with respect to the rocker, and a valve member, carrying the discharge valve, housed in a hollow portion of the first element the valve member being movable in translation with respect to the first element along a longitudinal axis of the piston, wherein the valve member comprises a pushing surface adapted to exert the valve opening force on the valve opening actuator, and wherein the valve member comprises at least one bleed passage adapted to allow passage of fluid from the hollow portion of the first element to the outside of the piston.

9. The valve actuation mechanism according to claim 8, wherein the valve member is movable with respect to the first element between a first position corresponding to a closed position of the discharge valve, in which a plate of the valve member is maintained, by action of a spring exerting a compression force between the first element and the valve member, in abutment against a stop of the first element, and in which passage of fluid between the chamber and the hollow portion of the first element is blocked, and a second position corresponding to an opened position of the discharge valve, in which the valve member is offset with respect to the first element and fluid can circulate between the chamber and the hollow portion of the first element.

10. The valve actuation mechanism according to claim 8, wherein the force of the stopper is exerted by contact between the stopper and the valve member, and wherein the compression force exerted by the spring is inferior to the force exerted by the stopper on the valve member.

11. The valve actuation mechanism according to claim 1, wherein the discharge valve is housed in the rocker apart from the piston.

12. The valve actuation mechanism according to claim 11, wherein the force of the stopper is exerted by contact between the stopper and the piston, and wherein the force exerted by the fluid in the chamber when the stopper is in contact with the piston is superior to the compression force exerted by the spring.

13. The valve actuation mechanism according to claim 12, wherein the rocker comprises a bleed passage fluidly linking the chamber and the outside of the rocker, and adapted to be selectively opened or closed by the discharge valve.

14. The valve actuation mechanism according to claim 1, wherein the force exerted by the stopper is variable and becomes superior to a force which keeps the discharge valve in a closed position only when the piston has to be moved from its second position to its first position and remains superior to the force until the piston is back in its first position.

15. The valve actuation mechanism according to claim 14, wherein the stopper comprises a main spring adapted, when deformed, to exert a compression force a pushrod on which the pushing zone is realized.

16. The valve actuation mechanism according to claim 15, wherein the activation piston activates an exhaust gases recirculation function when it is in its second position.

17. The valve actuation mechanism according to claim 1, wherein it is an exhaust valve actuation mechanism.

18. The valve actuation mechanism according to claim 17, wherein the activation piston activates an engine brake function when it is in its second position.

19. The valve actuation mechanism according to claim 1, wherein it is an intake valve actuation mechanism.

20. An automotive vehicle comprising a valve actuation mechanism according to claim 1.

* * * * *